US011754303B1

(12) United States Patent
Smith et al.

(10) Patent No.: US 11,754,303 B1
(45) Date of Patent: Sep. 12, 2023

(54) SYSTEMS AND METHODS FOR DIAGNOSING A LOSS OF CAPACITY OF A CLIMATE CONTROL SYSTEM

(71) Applicant: Trane International Inc., Davidson, NC (US)

(72) Inventors: Christopher Blake Smith, Whitehouse, TX (US); Evan Brunner, Tyler, TX (US); Jonathan Edward Thrift, Jacksonville, TX (US)

(73) Assignee: Trane International Inc., Davidson, NC (US)

( * ) Notice: Subject to any disclaimer, the term of this patent is extended or adjusted under 35 U.S.C. 154(b) by 68 days.

(21) Appl. No.: 17/216,197

(22) Filed: Mar. 29, 2021

Related U.S. Application Data

(60) Provisional application No. 63/003,036, filed on Mar. 31, 2020.

(51) Int. Cl.
*F24F 11/38* (2018.01)
*F24F 11/526* (2018.01)
*F24F 110/12* (2018.01)

(52) U.S. Cl.
CPC ..... *F24F 11/38* (2018.01); *F24F 11/526* (2018.01); *F24F 2110/12* (2018.01)

(58) Field of Classification Search
CPC ..... F24F 2110/12
See application file for complete search history.

(56) References Cited

U.S. PATENT DOCUMENTS

| | | | | |
|---|---|---|---|---|
| 4,262,736 | A | 4/1981 | Gilkeson et al. | |
| 4,472,177 | A * | 9/1984 | Sircar | B01D 53/0476 55/21 |
| 4,574,871 | A | 3/1986 | Parkinson et al. | |
| 10,332,021 | B1 | 6/2019 | Hoff | |
| 10,339,232 | B1 | 7/2019 | Hoff | |
| 10,344,997 | B2 | 7/2019 | Alsaleem | |
| 2007/0267508 | A1* | 11/2007 | Hoglund | F24F 11/62 236/49.1 |
| 2013/0158714 | A1 | 6/2013 | Barton et al. | |
| 2015/0276495 | A1* | 10/2015 | Smullin | G06Q 10/10 702/130 |
| 2017/0269618 | A1 | 9/2017 | Zywicki, III et al. | |
| 2019/0128554 | A1* | 5/2019 | Popli | F24F 11/65 |
| 2020/0041157 | A1* | 2/2020 | Salsbury | F24F 11/46 |

* cited by examiner

*Primary Examiner* — Santosh R Poudel
(74) *Attorney, Agent, or Firm* — Womble Bond Dickinson (US) LLP

(57) ABSTRACT

Methods and related systems for diagnosing a loss of capacity of a heating, ventilation, and air conditioning (HVAC) system are disclosed. In an embodiment, the method includes summing a runtime of an auxiliary heat source of the HVAC system over a plurality of time blocks. Additionally, the method includes summing an expected runtime of the auxiliary heat source over the plurality of time blocks. Further, the method includes comparing the runtime sum with the expected runtime sum, wherein the expected runtime for each of the plurality of time blocks is a function of an outdoor ambient temperature over a time-delay block beginning before the corresponding time block.

18 Claims, 5 Drawing Sheets

SYSTEMS AND METHODS FOR DIAGNOSING A LOSS OF CAPACITY OF A CLIMATE CONTROL SYSTEM

CROSS-REFERENCE TO RELATED APPLICATIONS

This application claims priority to, and the benefit of, U.S. Provisional Patent Application No. 63/003,036, titled SYSTEMS AND METHODS FOR DIAGNOSING A LOSS OF CAPACITY OF A CLIMATE CONTROL SYSTEM, filed on Mar. 31, 2020, which is incorporated herein in its entirety by reference.

BACKGROUND

A climate control system, such as a heating, ventilation, and air conditioning (HVAC) system, may control the environmental conditions (e.g., temperature, relative humidity, etc.) of an indoor space. Some climate control systems may be split-type heat pump systems that have an indoor air handling unit and an outdoor unit and are capable of heating a comfort zone by operating in a heating mode for transferring heat from an outdoor ambient area to a comfort zone using a refrigeration cycle. Some split-type heat pump systems may include an auxiliary heat source such as an electric heating element and/or an indoor furnace for providing auxiliary or supplemental heat to the comfort zone.

BRIEF SUMMARY

Some embodiments disclosed herein are directed to a method for diagnosing a loss of capacity of a heating, ventilation, and air conditioning (HVAC) system. In an embodiment, the method includes summing a runtime of an auxiliary heat source of the HVAC system over a plurality of time blocks. Additionally, the method includes summing an expected runtime of the auxiliary heat source over the plurality of time blocks. Further, the method includes comparing the runtime sum with the expected runtime sum, wherein the expected runtime for each of the plurality of time blocks is a function of an outdoor ambient temperature over a time-delay block beginning before the corresponding time block.

Other embodiments disclosed herein are directed to a non-transitory machine-readable medium. In an embodiment, the non-transitory machine-readable medium includes instructions that, when executed by a processor, cause the processor to sum a runtime of an auxiliary heat source of a heating, ventilation, and air conditioning (HVAC) system over a plurality of time blocks, and sum an expected runtime over the plurality of time blocks. In addition, the instructions, when executed by the processor, further cause the processor to compare the runtime sum with the expected runtime sum, wherein the expected runtime for each of the plurality of time blocks is a function of an outdoor ambient temperature over a time-delay block beginning before the corresponding time block.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
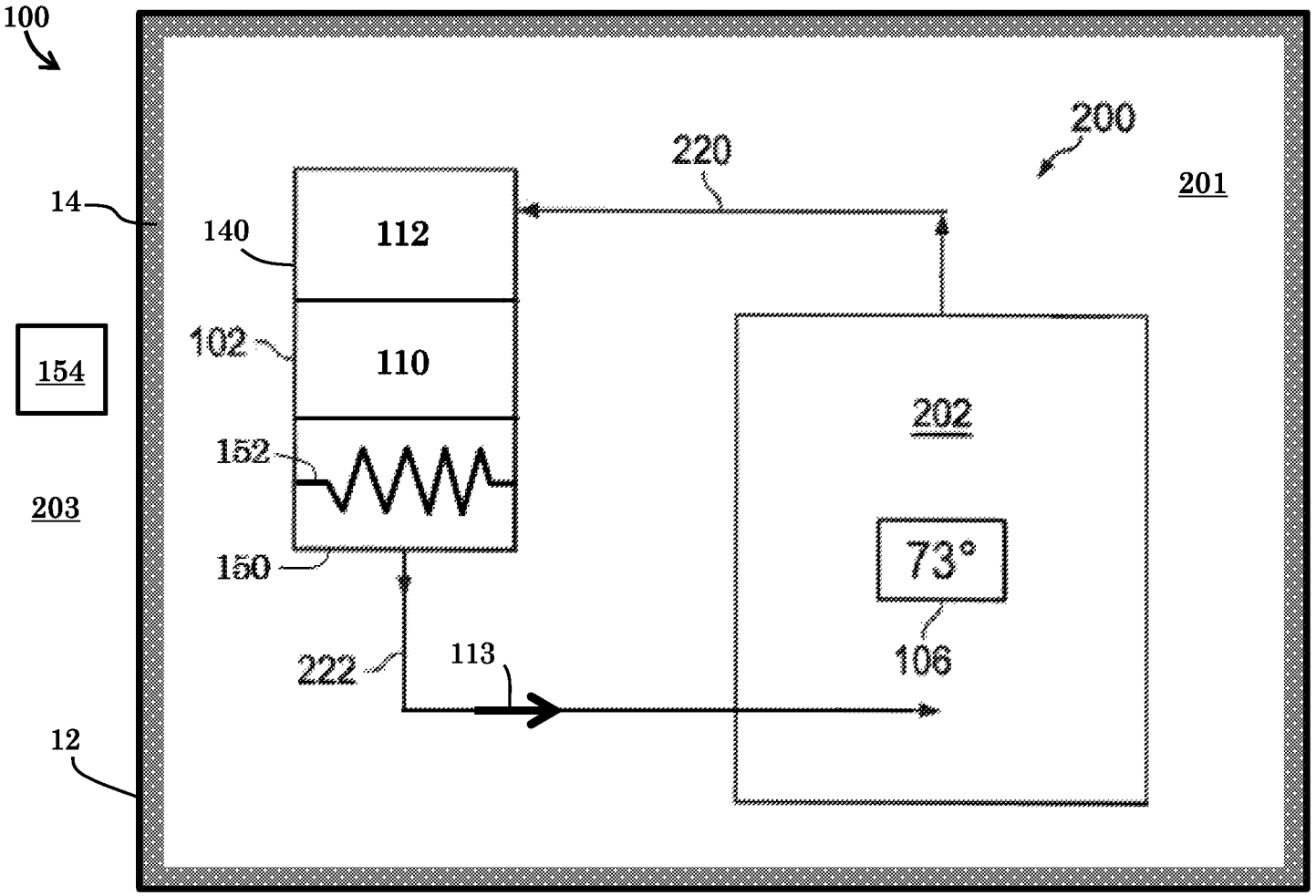
FIG. 1 is a schematic diagram of an air circulation path of a climate control system according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in the interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10% unless otherwise stated herein.

As previously described, climate control systems comprising split-type heat pump systems may include an auxiliary heat source for providing additional heat to a comfort zone of an indoor space. As will be further described herein, climate control systems which comprise split-type heat pump systems may heat the indoor space by transferring heat from an outdoor ambient environment surrounding the indoor space to the indoor space using a refrigeration cycle. An auxiliary heat source of the climate control system may provide auxiliary or supplemental heating to the indoor space by converting electrical energy (e.g., an electric heating element) and/or chemical energy (e.g., a fuel fired furnace) into heat, which may be transferred to the indoor space.

During the operational life of the climate control system, some of the capacity or amount of heating which the climate control system may provide using the refrigeration cycle may be lost for numerous reasons, including loss of refrigerant, a malfunctioning compressor or other component of the climate control system, loss of indoor or outdoor airflow, etc. In response to the loss of heating capacity from the refrigeration cycle, a runtime of the auxiliary heat source may be operated more often than what would otherwise be expected based on outdoor ambient conditions, in order to provide an amount of heating sufficient to heat the indoor space to a temperature setpoint defined by a user of the climate control system. Accordingly, embodiments disclosed herein include systems and methods for diagnosing a loss of heating capacity from a refrigeration cycle of a climate control system by comparing an actual runtime of an auxiliary heat source of the climate control system over an evaluation period with an expected runtime over the evaluation period based on outdoor ambient conditions. Some embodiments include a system and method for issuing an alert to a user of the climate control system notifying the user of a loss of heating capacity from a refrigeration cycle of the climate control system indicated by an actual runtime of an auxiliary heat source being greater than an expected runtime of the auxiliary heat source over an evaluation period.

Referring now to FIG. 1, a schematic diagram of an air circulation path 200 of a climate control system 100 is shown according to an embodiment of the disclosure. In this embodiment, climate control system 100 is an HVAC system, and thus, system 100 may be referred to herein as HVAC system 100. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode").

In addition to being operable in the heating mode, HVAC system 100 may also be operated in a so-called auxiliary heating mode to provide auxiliary or supplemental heating functionality (hereinafter "auxiliary heating mode"). In the auxiliary heating mode, heating (in addition to the heating provided by the refrigeration cycle) may be provided by an auxiliary heat source 150 of HVAC system 100 which is generally configured to convert electrical and/or chemical energy into thermal energy. In some embodiments, auxiliary heat source 150 includes an electric heating element 152 comprising a resistance heating element or coil which converts electrical energy supplied to electric heating element 152 into heat. However, in other embodiments, instead of electrical heating element 152, HVAC system 100 may include an auxiliary heat source in the form of a furnace generally configured to produce heat through the combustion of air and fuel (e.g., natural gas). In still other embodiments, HVAC system 100 may include both the auxiliary heat source 150 comprising electric heating element 152, a furnace separate from the indoor air handling unit, and/or other mechanisms for providing auxiliary heat.

Air circulation path 200 of HVAC system 100 extends through an indoor space 201 disposed within an external structure 12. Structure 12 may include thermal insulation 14 positioned between indoor space 201 and an outdoor ambient area 203 surrounding structure 12. Insulation 14 may comprise a material (e.g., fiberglass, cellulose, foam, etc.) having a low thermal conductivity to inhibit or delay the transfer of thermal energy between indoor space 201 and the surrounding ambient area 203. An outdoor temperature sensor 154 of HVAC system 100 may be positioned in the ambient area 203 proximal to structure 12 whereby HVAC system 100 may determine and monitor the outdoor ambient temperature in ambient area 203.

Figure 5:
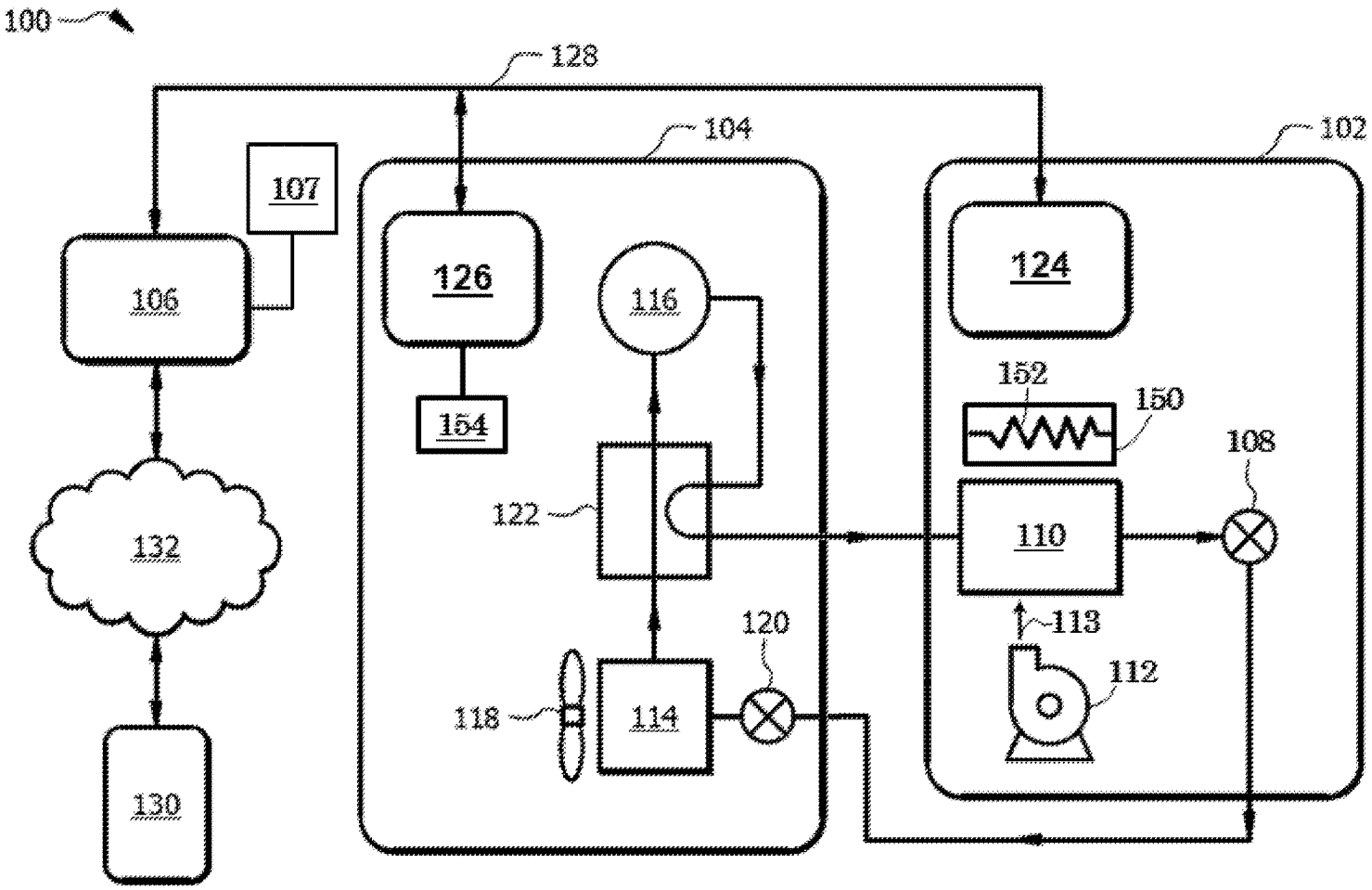
FIG. 5 is a diagram of the climate system of FIG. 1 configured for operating in a heating mode according to some embodiments.

Additionally, indoor space 201 may include a comfort zone 202 positioned therein. It will be appreciated that while a single comfort zone 202 is shown, any number of zones may be present in an indoor space 201 or structure 12. Where present, the plurality of zones may be conditioned independently or together in one or more groups. The air circulation path 200 of the HVAC system 100 may generally comprise a return duct 220 and a supply duct 222. The air circulation path 200 also passes through an air handler 140 of an indoor unit 102 of HVAC system 100, which may include, among other components, an indoor fan 112, an indoor heat exchanger 110, and the auxiliary heat source 150. Indoor unit 102, along with other components of HVAC system 100, are shown in FIG. 5 and are described in further detail below. In some embodiments, auxiliary heat source 150 may be positioned external air handler 140 of indoor unit 102. For instance, in some embodiments, auxiliary heat source 150 may comprise a plurality of electric heating elements 152 positioned along return duct 222.

In operation, the indoor fan 112 may be configured to generate an airflow 113 through air handler 140 to deliver temperature conditioned air from an air supply opening in the indoor unit 102, through supply duct 222, and to comfort zone 202 in response to a temperature or humidity sensed by at least one temperature sensor and/or humidity sensor carried by at least one of a system controller 106 (shown in FIG. 5) of HVAC system 100, a zone thermostat positioned in comfort zone 202, and/or a sensor positioned in comfort zone 202. Air from comfort zone 202 may return to the air handler 140 through return duct 220 and an air return opening in the air handler 140. Air entering the indoor air handler 140 through the air return opening may then be conditioned for delivery to comfort zone 202 as described above. Circulation of the air in this manner may continue repetitively until the temperature and/or humidity of the air within comfort zone 202 conforms to a target temperature as required by, for example, system controller 106. The target temperature of air within comfort zone 202 may comprise a temperature setpoint entered into an input/output (I/O) unit 107 (shown in FIG. 5) of HVAC system 100 by a user of HVAC system 100 (e.g., a homeowner, a technician of HVAC system 100, etc.).

As described above, HVAC system 100 may be operated in the heating mode to transfer heat from the indoor heat exchanger 110 to the airflow 113 provided by indoor fan 112, which may be provided to comfort zone 202 via supply duct 222. Additionally, HVAC system 100 may also be operated in the auxiliary heating mode whereby, in addition to transferring heat from heat exchanger 110 to airflow 113, auxiliary heat source 150 may be operated to transfer heat from electric heating element 152 to airflow 113. HVAC system 100 may be operated in the auxiliary heating mode in response to changes in ambient conditions, such as a decline in the outdoor ambient temperature.

Particularly, given that the refrigeration cycle utilized by HVAC system 100 to heat comfort zone 202 in the heating mode relies on transferring heat from air in the outdoor ambient area 203 surrounding structure 12, as temperature in the outdoor ambient area 203 declines, the capacity from the refrigeration cycle of HVAC system 100 to heat comfort zone 202 concomitantly declines as there is less heat to draw from the air in the outdoor ambient area 203. At a fixed temperature setpoint for the comfort zone 202, a decline in outdoor ambient temperature also increases the load demand on HVAC system 100. Thus, a continual decline of outdoor ambient temperature at a fixed temperature setpoint will eventually result in the capacity from the refrigeration cycle of HVAC system 100 falling below the load demand applied to HVAC system 100, a condition sometimes referred to as falling below the "balance point" of the refrigeration cycle, or the point at which the heating capacity of the refrigeration cycle equals the load applied to HVAC system 100. Once HVAC system 100 falls below the balance point of the refrigeration cycle, auxiliary or supplemental heating may be required to boost the amount of heat transferred to the airflow 113 produced by indoor fan 112 such that the load demand applied to HVAC system 100 is satisfied.

In addition to continually declining outdoor ambient temperature, HVAC system 100 may also fall below the balance point following an increase in the user defined temperature setpoint of comfort zone 202 in cold, yet stable conditions, and in some embodiments, the system only falls below the balance point for a temporary period of time. For instance, HVAC system 100 may be operating in the heating mode a few degrees above the balance point in conditions where the temperature of air in the outdoor ambient area 203 is stable, and, following an increase in the temperature setpoint of comfort zone 202 by a user of HVAC system 100, may fall below the balance point and thus require the operation of auxiliary heat source 150 to temporarily boost the heating capacity of HVAC system 100 such that the increased load demand applied to HVAC system 100 may be met. In other words, when a user increases the setpoint, the HVAC system may be configured to reach the new set point as quickly as possible. Achieving a quick ramp up in indoor air temperature may require capacity that exceeds the amount available from a refrigeration cycle in heating mode alone.

Figure 2:
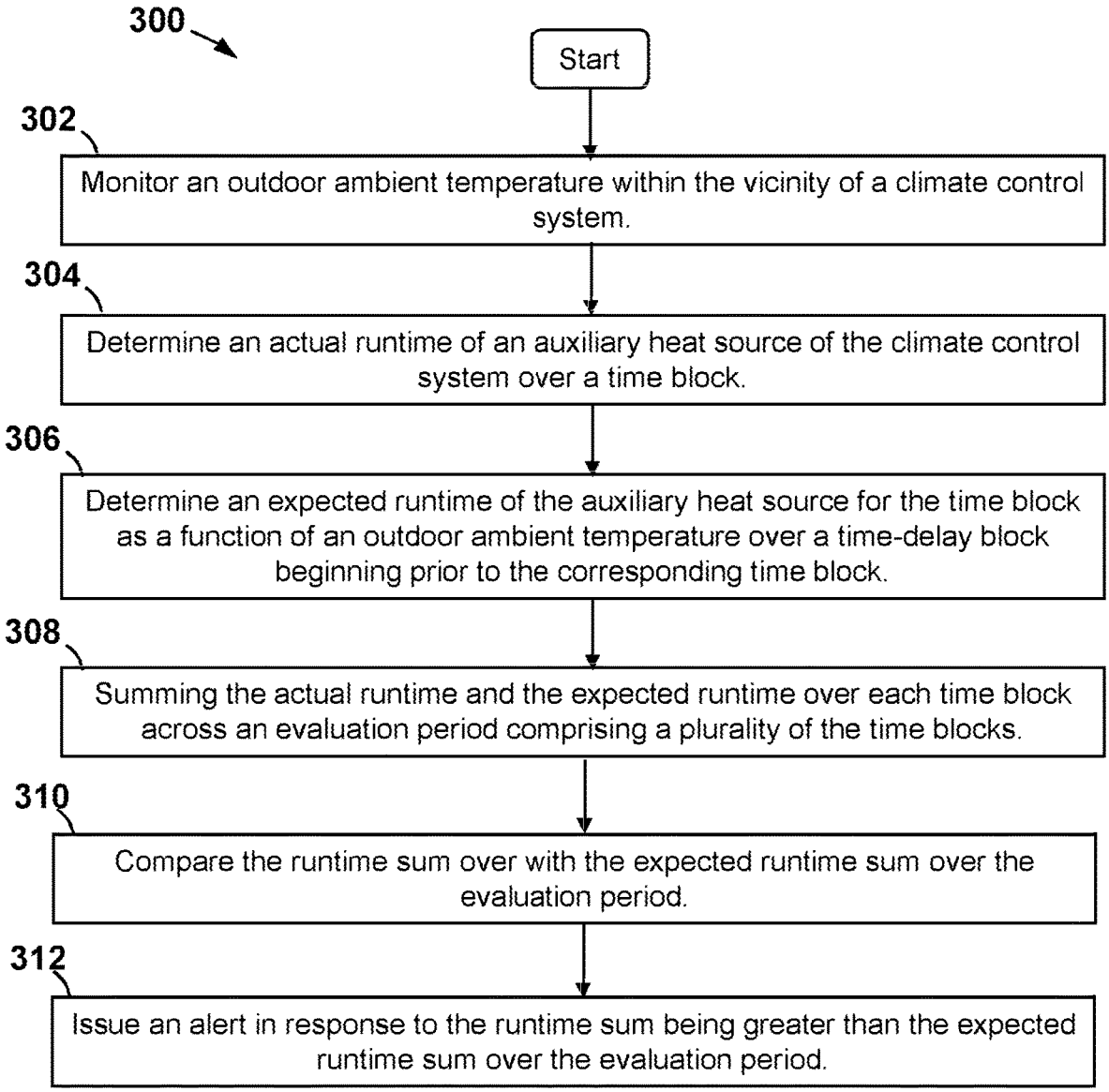
FIG. 2 is a flow chart of a method for diagnosing a loss of capacity of a climate control system according to some embodiments.

Referring now to FIG. 2, a method 300 of diagnosing a loss of capacity of a climate control system is shown. In some embodiments, method 300 may be practiced with HVAC system 100 shown in FIGS. 1, 5. Specifically, in some embodiments, method 300 may be performed at least partially by a remote device 130 shown in FIG. 5 in communication with a controller of HVAC system 100 via a communication network 132 also shown in FIG. 5 and which is described in further detail below. For instance, in some embodiments, remote device 130 may comprise a cloud server and method 300 may be performed at least partially by a cloud application installed on the cloud server. In some embodiments, method 300 may be performed at least partially by other components of HVAC system 100, such as, for example, controllers 124, 126, and/or I/O unit 107. However, it should be appreciated that embodiments of method 300 may be practiced with other systems, assemblies, and devices other than those described above.

Initially, method 300 includes monitoring an outdoor ambient temperature within a vicinity of a climate control system at block 302. Block 302 may include monitoring the outdoor ambient temperature using an outdoor temperature sensor of the climate control system. For example, block 302 may include monitoring the temperature of air in the outdoor ambient area 203 using the outdoor temperature sensor 154 shown in FIG. 1, which is proximal the external structure 12 in which the comfort zone 202 heated by HVAC system 100 is located. In some embodiments, system controller 106 of HVAC system 100 may communicate the outdoor ambient temperature determined by outdoor temperature sensor 154 continually (e.g., at a predetermined frequency) to remote device 130 via communication network 132, where remote device 130 may comprise a remote server including a database for recording the outdoor ambient temperature measurements. In other embodiments, instead of receiving outdoor temperature measurements from outdoor temperature sensor 154 via a communication network 132 shown in FIG. 5 and described further below, remote device 130 may be configured to continually obtain outdoor ambient temperature measurements within the vicinity (e.g., within the same ZIP or postal code) of HVAC system 100 via publicly available sources accessed using communication network 132, where communication network 132 comprises the Internet and remote device 130 comprises a remote server.

Method 300 continues at block 304 by determining an actual runtime of an auxiliary heat source of a climate control system over a time block. In some embodiments, block 304 may comprise determining an actual runtime of the auxiliary heat source 150 over a time block having a predetermined duration, and in some embodiment, it may determine or monitor the amount of heat being provided by the auxiliary heat source 150 over the time block. The duration of the time block may be predefined and stored in a memory of HVAC system 100 (e.g., a memory of system controller 106) and/or a memory of remote device 130. In an example, the duration of the time block may comprise an hour; however, the duration of the time block may vary. For example, in some embodiments, the duration of the time block may be between about fifteen minutes to about six hours in duration.

In some embodiments, a remote device (e.g., remote device 130 shown in FIG. 5) may monitor the amount of time HVAC system 100 is operated in the auxiliary heating mode with electric heating element 152 transferring heat to airflow 113 (i.e., a runtime of auxiliary heat source 150) over the time block based on data transmitted to the remote device from a controller (e.g., system controller 106) of HVAC system 100. For instance, the remote device may periodically monitor, at a fixed frequency, whether the auxiliary heat source is currently being operated, and in some embodiment, it may determine or monitor the amount of heat being provided by the auxiliary heat source 150. Alternatively, the controller of HVAC system 100 may transmit data to the remote device indicative of changes in status (e.g., an "on" or operating status and an "off" or disabled status) of the auxiliary heat source, and based on the data transmitted from the controller, the remote device may determine the duration of each status extending between the status changes.

In some embodiments, remote device 130 may determine the actual runtime of auxiliary heat source 150 for each time block over a plurality of sequentially-ordered time blocks. The controller of HVAC system 100 may individually and continuously communicate to remote device 130 data indicative of the runtime of auxiliary heat source 150 for each time block or may communicate in a single batch data indicative of the runtime of auxiliary heat source 150 for a plurality of time blocks.

In another example, rather than communicating a batch of data indicative of the actual runtime of auxiliary heat source 150 over a plurality of time blocks, the controller of HVAC system 100 may continuously communicate data to remote device 130 indicative of the actual runtime of auxiliary heat source 150 for each respective time block.

Referring again to FIG. 2, method 300 proceeds at block 306 by determining an expected runtime of the auxiliary heat source over the time block. In one embodiment, the expected runtime is a function of an average outdoor ambient temperature during the respective time block. In other embodiments, the expected runtime is a function of a minimum outdoor ambient temperature during the respective time block. In another embodiment, the expected runtime is a function of at least one of a minimum outdoor ambient temperature, an average outdoor ambient temperature, a median outdoor ambient temperature, and a lowest quartile outdoor ambient temperature occurring over a time-delay block. In another embodiment, the expected runtime is a function of two or more of a minimum outdoor ambient temperature, an average outdoor ambient temperature, a median outdoor ambient temperature, and a lowest quartile outdoor ambient temperature occurring over a time-delay block. For example, in some embodiments, the expected runtime is determined based on a given average outdoor ambient temperature, and potentially adjusted if the lowest quartile outdoor ambient temperature is below a given value. Other combinations of these values may be used to determine an expected runtime. A time-delay block has a duration that is greater than the duration of the respective time block, and provides a look-back period such that the time-delay block begins before, but generally ends concurrent with the respective time block.

In some embodiments, method block 306 may comprise a controller of the HVAC system 100 system (e.g., system controller 106) and/or remote device 130 determining the expected runtime of auxiliary heat source 150. Returning to the example described above at block 304, in an embodiment, remote device 130 may determine an expected runtime for each time block of the plurality of twenty-four time blocks. For instance, where the duration of the time-delay block is equal to two hours, the remote device 130 may determine the expected runtime of auxiliary heat source 150 for the 12 PM to 1 PM time block as a function of outdoor ambient temperature between 11 AM to 1 PM (e.g., the lowest outdoor temperature occurring between 11 AM and 1 PM, the average outdoor temperature between 11 AM and 1 PM, etc.).

Similarly, in this example, the remote device 130 may determine the expected runtime for the 4 PM to 5 PM time block as a function of outdoor ambient temperature between 3 PM and 5 PM (e.g., the lowest outdoor temperature occurring between 3 PM and 5 PM, the average outdoor temperature between 3 PM and 5 PM, etc.). The outdoor ambient temperature may be determined using outdoor temperature sensor 154 and/or from publicly available sources accessed using communication network 132. Additionally, although in this example the duration of the time-delay block is two hours, in other embodiments, the duration of the time-delay block may vary.

As described above with respect to the HVAC system 100, the comfort zone is typically insulated from the ambient space to at least some degree, delaying the transfer of thermal energy between an indoor space and the outdoor ambient area. In other words, thermal resistance of the external structure may increase the time required for outdoor ambient temperature to penetrate the structure and act upon a comfort zone positioned within the structure The delay in the transfer of thermal energy provided by a thermal resistance of the external structure may result in a greater actual runtime of the auxiliary heat source for a given time block than what would be expected based on the lowest temperature of only the current time block.

Figure 3:
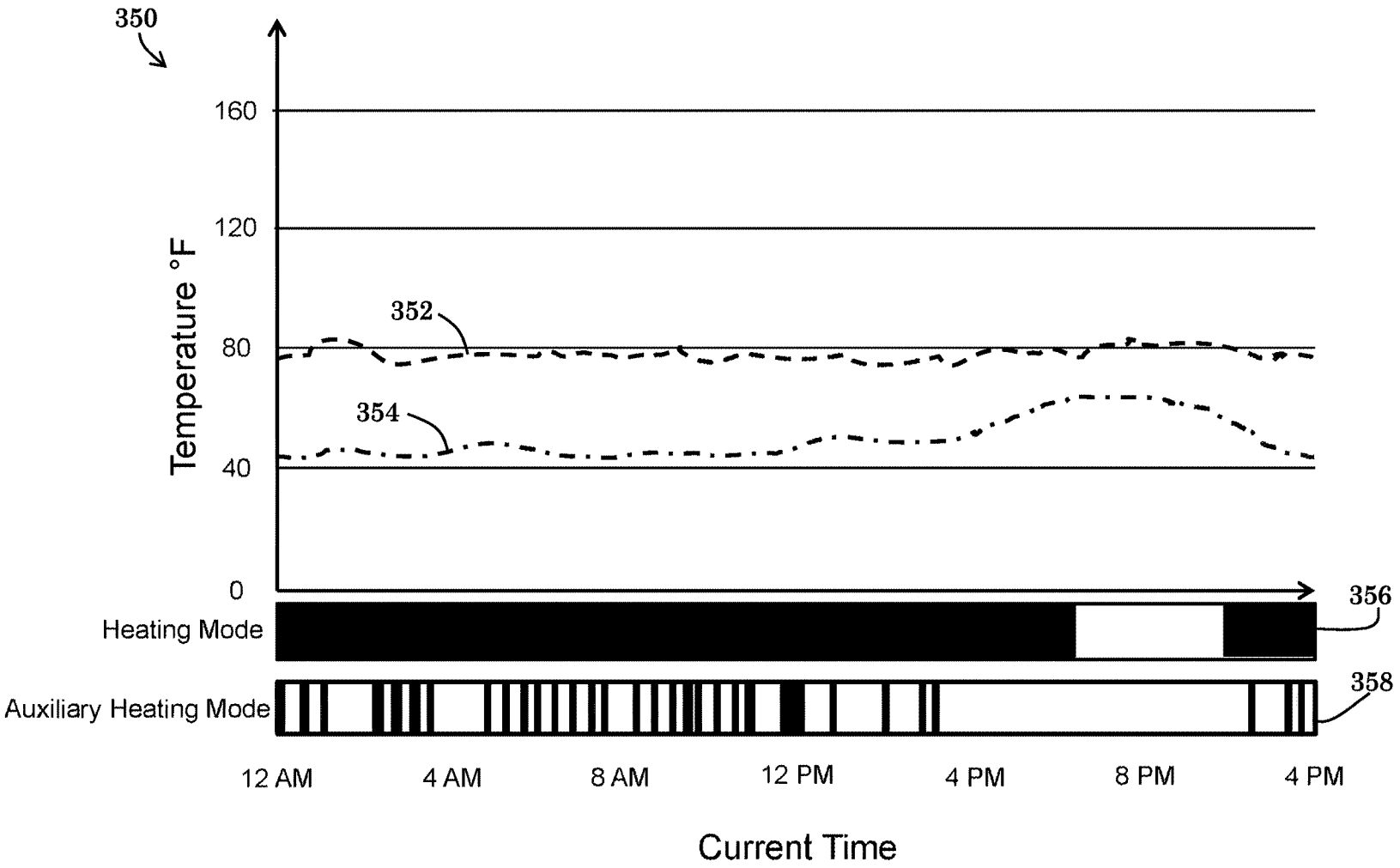
FIG. 3 is a chart illustrating parameters of a climate control system according to some embodiments.

For example, referring to FIG. 3, an example chart 350 is shown that illustrates parameters of a climate control system (e.g., HVAC system 100) and which comprises an X-axis indicating a current time over a given day during the operational life of the HVAC system and a Y-axis indicating temperature in degrees Fahrenheit (° F.). Chart 350 indicates an indoor temperature 352 of a comfort zone (e.g., comfort zone 202 shown in FIG. 1) of an external structure comprising thermal insulation (e.g., thermal insulation 14 of structure 12) and an outdoor ambient temperature 354 (e.g., the temperature of outdoor ambient area 203) within the vicinity of the climate control system, where the indoor temperature 352 and outdoor ambient temperature 354 may be determined by sensors of the climate control system.

Additionally, chart 350 indicates a heating mode status bar 356 that extends throughout the particular day indicated by the X-axis, where filled portions of the heating mode status bar 356 indicate the climate control system being operated in the heating mode (e.g., a mode similar to the heating mode described above with respect to HVAC system 100) while unfilled portions of the heating mode status bar 356 indicate the climate control system not providing heat. For instance, during the particular day indicated in chart 350, the climate control system operated in the heating mode at 4 PM but did not operate in the heating mode at 8 PM. Further, chart 350 includes an auxiliary heating mode status bar 358 that extends throughout the particular day indicated by the X-axis. Filled portions of the auxiliary heating mode status bar 358 indicate the climate control system being operated in the auxiliary heating mode (e.g., a mode similar to the auxiliary heating mode described above with respect to HVAC system 100) while unfilled portions of the auxiliary heating mode status bar 358 indicate the climate control system not providing auxiliary heat. For instance, during the particular day indicated in chart 350, the climate control system operated in the auxiliary heating mode at 12 PM but did not operate in the auxiliary heating mode at 4 AM. Instead, the climate control system was operated only in the heating mode at 4 AM.

In the exemplary chart 350 shown in FIG. 3, although the outdoor temperature 354 increased approximately 15° F. between 4 PM (approximately 50° F.) and 6 PM (approximately 65° F.), the relatively colder outdoor ambient air at 4 PM may continue to impact the load demand applied to the climate control system at 6 PM due to the thermal resistance of the exterior structure. In other words, the thermal resistance of the structure acts to delay the effects of changes in outdoor ambient temperature on conditions in the comfort zone.

Referring again to FIG. 2, method 300 accounts for the delay in heat transfer between an outdoor ambient area and an indoor space by basing the expected runtime determined at block 306 off of the time-delay block, which may have a greater duration than the time block. By utilizing a time-delay block having a look-back period (preceding the corresponding time block) for determining the lowest outdoor temperature upon which the expected runtime for the corresponding time block is based, recent outdoor ambient temperature changes may not result in an underestimation of the expected runtime of the auxiliary heat source over the time block.

In some embodiments, the duration of the time-delay block may be between about one and about four times the duration of the corresponding time block. Given that the look-back period preceding a time block having a relatively long duration is less recent and thus having a lesser effect on conditions within the comfort zone of the indoor space, the ratio of the duration of the time-delay block to the duration of the corresponding time block may be a function of the duration of the time block. Particularly, the ratio of the duration of the time-delay block to the duration of the corresponding time block may be greater (e.g., a ratio of between about 2.0 to 4.0) in embodiments where the duration of the time block is relatively brief (e.g., fifteen to thirty minutes) and lesser (e.g., a ratio of between about 1.0 to 2.0) in embodiments where the duration of the time block is relatively long (e.g., four or more in duration), where a ratio of 1 means that the time-delay block is the same duration as the corresponding time block. In one embodiment, the time block may be 1-hour long and the time-delay block may be 2-hours long, a ratio of 2.0.

Further, rather than performing the costly, cumbersome process of determining the thermal resistance of each external structure to which method 300 is applied, a time-delay block of a given duration may be used in determining the expected runtime at block 306 across an array of external structures having different heat transfer properties. Particularly, by utilizing a time-delay block have a sufficiently large duration when determining the expected runtime at block 306, differences in heat transfer properties across varying external structures may be obviated, minimizing the effort and cost in determining the expected runtime of the auxiliary heat source.

For example, if a plurality of external structures having varying degrees of thermal resistance have a heat transfer delay ranging between one to two hours, an expected runtime may be determined for the auxiliary heat source of the climate control system of each external structure based on a time-delay block having a two-hour duration. Thus, in this example, rather than using a unique duration for each climate control system, a single two-hour duration may be used for each climate control system to prevent the underestimation of the expected runtime for each system.

The expected runtime determined at block 306 may also be based on a predetermined heating capacity of the climate control system. Particularly, prior to installation at the external structure, the climate control system, or individual components thereof (e.g., air handler 140, etc.) may be tested to empirically estimate the heating capacity of the climate control system for heating in both the heating and auxiliary heating modes described above over a range of controlled, known conditions.

Additionally, for climate control systems which comprise split-type heat pump systems (e.g., HVAC system 100), testing under controlled conditions prior to installation may be used to estimate a design temperature of the heat pump system comprising a temperature at which (and above) the refrigeration cycle of the heat pump system is at maximum heating capacity and may thus provide the maximum amount of heating for the given heating capacity of the refrigeration cycle of the climate control system. Further, testing under controlled conditions may be used to estimate the decline in heating capacity (due to the decline in available heat to draw from the surrounding ambient environment) from the refrigeration cycle of the heat pump system at temperatures below the design temperature of the heat pump system. Thus, testing of a heat pump type climate control system prior to installation may allow for the estimation of the maximum heating capacity of the refrigeration cycle of the climate control system, the design temperature comprising the lowest temperature at which the system may provide maximum heating capacity, and the decline in heating capacity of the refrigeration cycle of the climate control system as a function of temperature for temperatures below the design temperature.

Not intending to be bound by any theory, an expected runtime of an auxiliary heat source (e.g., auxiliary heat source 150 of the HVAC system 100) may be determined in accordance with the following computation, where $\text{Runtime}_{exp}$ comprises the expected runtime of an auxiliary heat source (e.g., auxiliary heat source 150) for a particular time block, DT comprises the design temperature of the climate control system, $\text{ODT}_{eff}$ comprises the effective outdoor ambient temperature, and C is a predetermined constant having units of time over temperature (e.g., $$\frac{(\text{hours})}{(^\circ F)}$$

and representative of the anticipated decline in heating capacity of the refrigeration cycle of the climate control system at temperatures below the design temperature DT of the system:

$$\text{Runtime}_{exp}=(\text{DT}-\text{ODT}_{eff})*C \tag{1}$$

$\text{ODT}_{eff}$ of Equation (1) may comprise the lowest outdoor ambient temperature over the time-delay block upon which the actual runtime of block 306 is based. For instance, referring briefly to FIG. 3, in an example where each time block is an hour in length and in which the time-delay block comprises two hours, the $\text{ODT}_{eff}$ of Equation (1) for the 5 PM to 6 PM time block may comprise, e.g., the minimum outdoor ambient temperature 354 occurring between 4 PM and 6 PM, which is shown in chart 350 as being approximately 50° F. Referring again to FIG. 2, when $\text{ODT}_{eff}$ of the time-delay block under consideration is equal to or greater than the design temperature DT, the expected runtime determined at block 306 equals zero in some embodiments.

As described above, both the design temperature DT and constant C of Equation (1) may be estimated from testing of the climate control system (e.g., HVAC system 100) or a related climate control system under controlled conditions prior to the installation of the climate control system. Thus, design temperature DT and constant C of Equation (1) are dependent upon the configuration of the climate control system, and thus may vary between differently configured climate control systems. However, neither design temperature DT nor constant C of Equation (1) are dependent on the configuration of the external structure (e.g., structure 12) comprising the comfort zone heated by the climate control system.

In some embodiments, Equation (1), including design temperature DT for the climate control system being monitored (e.g., HVAC system 100), constant C of the climate control system, and the duration of the time-delay block may be stored in a memory of a remote device (e.g., remote device 130). The remote device may determine the expected runtime for each time block of outdoor ambient temperature (e.g., outdoor ambient temperature 354) received from (continuously or in batches on a predetermined cadence (e.g., daily)) a controller of the climate control system (e.g., system controller 106). In other embodiments, the controller of the climate control system may determine the expected runtime for each time block of outdoor ambient temperature.

Method 300 proceeds at block 308 by summing the actual runtime and expected runtime, respectively, over an evaluation period comprising a plurality of the time blocks. Not intending to be bound by any theory, the actual runtime and expected runtime over the evaluation period may be determined in accordance with the following relationships, where $Runtime_{act_i}$ comprises the actual runtime over each time block i, $RuntimeSum_{act}$ comprises a runtime sum or the actual runtime over the evaluation period extending over a total number of time blocks n, $Runtime_{exp_i}$ comprises the expected runtime over each time block i, and $RuntimeSum_{exp}$ comprises an expected runtime sum or the expected runtime over the evaluation period extending over the total number of time blocks n:

$$RuntimeSum_{act} = \sum_{i=1}^{n} (Runtime_{act_i}) \quad (2)$$

$$RuntimeSum_{exp} = \sum_{i=1}^{n} (Runtime_{exp_i}) \quad (3)$$

The evaluation period over which the actual runtime and expected runtime are summed may comprise a plurality of the time blocks and may have a duration that is at least as long as the duration of the time-delay block. In an embodiment, the evaluation period may comprise a single four hour period and may thus, for example, include four consecutive one hour time blocks. In this example, $RuntimeSum_{act}$ of Equation (2) may be determined by summing the actual runtime for each of the four one hour time blocks of the evaluation period; and $RuntimeSum_{exp}$ of Equation (3) may be determined by summing an expected runtime of the auxiliary heat source for each of the four one hour time blocks of the evaluation period. For instance, if the $RuntimeSum_{act}$ for the 12 AM to 1 AM, 1 AM to 2 AM, 2 AM to 3 AM, and 3 AM to 4 AM time blocks are, respectively, 0.1 hours, 0.4 hours, 0.2 hours and 0.3 hours then the $RuntimeSum_{act}$ of the auxiliary heat source over the four hour evaluation time period in this example equals 0.1 hours+0.4 hours+0.2 hours+0.3 hours or 1.0 hours. Additionally, if the $Runtime_{exp}$ for the 12 AM to 1 AM, 1 AM to 2 AM, 2 AM to 3 AM, and 3 AM to 4 AM time blocks are determined using Equation (1) above as equaling 0.1 hours, 0.2 hours, 0.2 hours, and 0.1 hours, respectively, then the $RuntimeSum_{exp}$ of the auxiliary heat source over the four hour evaluation time period in this example equals 0.1 hours+0.2 hours+0.2 hours+0.1 hours or 0.6 hours. Although in this example the evaluation period comprises a total of four hours, the duration of the evaluation period may vary and may comprise, for instance, a day (e.g., twenty-four, one hour time blocks, twelve, two hour time blocks, etc.) or longer in duration.

In some embodiments, the duration of each time block and each corresponding time-delay block of the evaluation period may be static and have a fixed length (e.g., one hour for each time block and two hours for each time-delay block). In other embodiments, the duration of each time block may be dynamic and may be a function of outdoor ambient conditions. For example, the duration of each time block may vary depending on the stability of outdoor ambient temperature. Particularly, if at a point in time during the evaluation period the outdoor ambient temperature declines or otherwise fluctuates rapidly, the duration of the time blocks following the outdoor ambient temperature fluctuation may be decreased in length. Decreasing the length of one or more time blocks in response to an increase in variance in outdoor ambient conditions may allow method 300 to react more swiftly to changing outdoor ambient conditions such that the $Runtime_{exp}$ of each time block more accurately models the expected runtime of the auxiliary heat source for the time block in question.

During operation of the climate control system, a user of the system (e.g., a home owner, an installer of the climate control system, etc.) may adjust a temperature setpoint for an indoor space (e.g., for comfort zone 202 of the indoor space 201). For instance, in the interest of the user's comfort, the user may increase the temperature setpoint by one or more degrees to provide additional heating to the indoor space. In response to an increase in the temperature setpoint by the user of the climate control system, the system may operate the auxiliary heat source (e.g., auxiliary heat source 150) to minimize the time required to raise the temperature of air within the indoor space to equal the new temperature setpoint, irrespective of whether the climate control system is above or below the balance point following the setpoint change. Thus, the runtime of the auxiliary heat source following a temperature setpoint change may be greater than what would otherwise be expected based on outdoor ambient conditions and the heating capacity of the refrigeration cycle of the climate control system.

Figure 4:
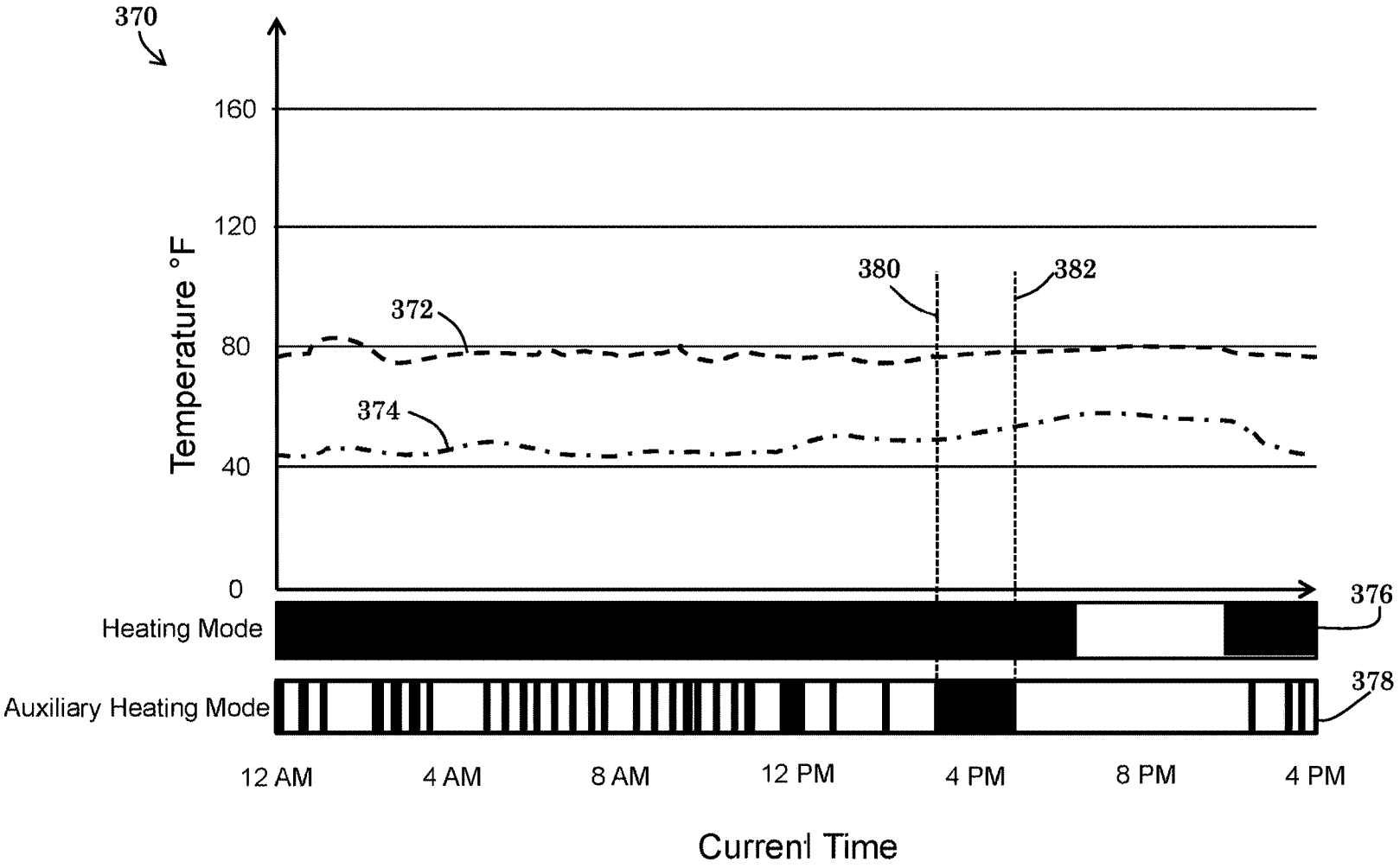
FIG. 4 is another chart illustrating parameters of a climate control system according to some embodiments.

For example, referring to FIG. 4, another chart 370 is shown which indicates an indoor temperature 372 of a comfort zone (e.g., comfort zone 202 shown in FIG. 1) of an external structure comprising thermal insulation (e.g., thermal insulation 14 of structure 12) and an outdoor ambient temperature 374 (e.g., the temperature of outdoor ambient area 203), a heating mode status bar 376 that extends throughout the particular day, and an auxiliary heating mode status bar 378 that extends throughout the particular day. As indicated by dotted line 380 in exemplary chart 370, at approximately 3 PM, a temperature setpoint of the comfort zone is increased from approximately 74° F. to approximately 76° F. resulting, in this example, for the climate control system to operate in the auxiliary heating mode (indicated by auxiliary heating mode status bar 378) from approximately 3 PM to approximately 4 PM (indicated by dotted line 382).

Referring again to FIG. 2, in view of the above, block 308 may also include excluding a duration of time from the evaluation period which directly follows a user initiated temperature setpoint change for the indoor space heated by the climate control system. Not intending to be bound by any theory, the amount of time of the evaluation period which may be excluded may be determined from the following relationship, where $T_{exc}$ comprises the duration of time to be excluded, $SP_{new}$ comprises the temperature setpoint directly following the temperature setpoint change, IDT comprises the current temperature in the indoor space (e.g., current temperature in comfort zone 202 shown in FIG. 1), and $C_{sp}$ comprises a predetermined sensitivity constant:

$$T_{exc} = \frac{(SP_{new} - IDT)}{C_{sp}} \quad (4)$$

In an example, constant $C_{sp}$ may comprise 1° F. per hour, current temperature in the indoor space of 76° F., and a user may increase a temperature setpoint for an indoor space to 78° F. ($SP_{new}$), providing, in accordance with Equation (4), two hours ($T_{exc}$) to be excluded or removed from the evaluation period. For instance, if the evaluation period extends between 1 PM and 5 PM, $C_{sp}$ comprises 1° F. per hour, the current temperature in the indoor space is 76° F. and the temperature setpoint is increased at 3 PM to 78° F. (as shown in the exemplary chart 370 of FIG. 4), then in accordance with Equation (4), $T_{exc}$ would comprise two hours and the portion of the evaluation period extending between 3 PM and 5 PM would be excluded. Thus, in this example, $RuntimeSum_{act}$ for the evaluation period would comprise the summed $Runtime_{act}$ for the 1 PM to 2 PM time block and the 2 PM to 3 PM time block (assuming each time block comprises an hour in this example); and $RuntimeSum_{exp}$ for the evaluation period would comprise the summed $Runtime_{exp}$ for the 1 PM to 2 PM time block and the 2 PM to 3 PM time block. While in this examples constant $C_{sp}$ comprises 1° F. per hour, constant $C_{sp}$ may vary depending on the configuration of the climate control system.

In some embodiments, rather than determining $T_{exc}$ based on current indoor temperature IDT, $T_{exc}$ may be determined based on the difference between the current temperature setpoint and the temperature setpoint directly preceding the temperature setpoint change. For instance, not intending to be bound by any theory, the amount of time of the evaluation period which may be excluded ($T_{exc}$) may be determined from the following relationship, where $SP_{old}$ comprises the temperature setpoint directly preceding the temperature setpoint change:

$$T_{exc} = \frac{(SP_{new} - SP_{old})}{C_{sp}} \tag{5}$$

Method 300 continues at block 310 by comparing the actual runtime over the evaluation period with the expected runtime over the evaluation period. Not intending to be bound by any theory, block 310 may compare the actual runtime and the expected runtime in accordance with the following relationship:

$$RuntimeSum_{act} > RuntimeSum_{exp} \tag{6}$$

Thus, in accordance with Equation (6), the $RuntimeSum_{act}$ determined in accordance with Equation (2) above may be compared with the $RuntimeSum_{exp}$ determined in accordance with Equation (3) above. In some embodiments, Equations (2)-(6), as well as the duration of the evaluation period and the value of constant $C_{sp}$, may be stored in a memory of a remote device (e.g., remote device 130). The remote device (e.g., a cloud server) may thus compare the actual runtime over the evaluation period with the expected runtime over the evaluation period. In other embodiments, the controller of the climate control system may compare the actual runtime over the evaluation period with the expected runtime over the evaluation period.

Method 300 continues at block 312 by issuing an alert to a user of the climate control system in response to the actual runtime being greater than the expected runtime over the evaluation period. Block 312 may include issuing an alert to the user of the climate control system (e.g., a homeowner, a technician or dealer of the climate control system, etc.) in response to Equation (6) presented above being true, or in other words, the actual runtime over the evaluation period being greater than the expected runtime over the evaluation period. The alert may notify the user of the climate control system that heating capacity from the refrigeration cycle of the climate control system has been lost as indicated by the actual runtime of the auxiliary heat source being greater than what would be expected based on outdoor ambient conditions. In some embodiments, the alert may be issued to or by systems remote of the climate control system which monitor the climate control system. For example, the alert may be issued by a remote device (e.g., remote device 130) to personnel equipped to repair or perform maintenance on the climate control system in response to receiving the alert. In other embodiments, a controller of the climate control system (e.g., system controller 106) may issue the alert to an occupant of the structure heated by the climate control system (e.g., a homeowner).

In some embodiments, the system and method disclosed herein further account for changes to the amount of auxiliary heat being provided within a given time block. For example, in some embodiments, the auxiliary heat source may be a staged device, which may adjust the amount of heat provide by adjusting the number of heating stages activated at a given time. In other embodiments, the auxiliary heat source may adjust the heat provided in other ways, and in some embodiments, the auxiliary heat source may be fully adjustable, providing heat at a range between 0%-100% of its heating capacity. In some embodiments, the system and method disclosed herein account for this varying heating by adjusting the actual runtime determined, potentially at step 304. For example, in some embodiments, if the auxiliary heat source is providing 50% heating during a time block the method may determine that the actual runtime of the system was less than the measured runtime, potentially half as long. In other embodiments, the method may account for this varied heating by adjusting the expected runtime, potentially at step 306. For example, in some embodiments, if the auxiliary heat source is providing 50% heating the system may increase the expected runtime, potentially doubling that amount of time. In some embodiments, the system calculates the expected run time based on the anticipated number of stages or percent capacity the auxiliary heat source provides at a given outdoor ambient air temperature (or other system conditions). If the system determines that the auxiliary heater is providing a greater or lesser capacity than anticipated, the system may account for this adjustment as discussed above and/or issue an alert.

Referring now to FIG. 5, a schematic diagram of the climate control system 100 referred to above, and which may be used to at least partially implement method 300 described above, is shown. In this embodiment, the HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor metering device 108, indoor heat exchanger 110, indoor fan 112, an indoor controller 124, and auxiliary heat source 150. The indoor metering device 108 may generally comprise an electronically-controlled motor-driven electronic expansion valve (EEV). In some embodiments, however, the indoor metering device 108 may comprise a thermostatic expansion valve, a capillary tube assembly, and/or any other suitable metering device. In some embodiments, while the indoor metering device 108 may be configured to meter the volume and/or flow rate of refrigerant through the indoor metering device 108, the indoor metering device 108 may also comprise and/or be associated with a refrigerant check valve and/or refrigerant bypass configuration when the direction of refrigerant flow through the indoor metering device 108 is such that the indoor metering device 108 is not intended to meter or otherwise substantially restrict flow of the refrigerant through the indoor metering device 108.

The indoor heat exchanger 110 may generally be configured to promote heat exchange between refrigerant carried within internal tubing of the indoor heat exchanger 110 and an airflow that may contact the indoor heat exchanger 110 but that is segregated from the refrigerant. In some embodiments, the indoor heat exchanger 110 may comprise a plate-fin heat exchanger. However, in other embodiments, indoor heat exchanger 110 may comprise a microchannel heat exchanger and/or any other suitable type of heat exchanger.

The indoor fan 112 may generally comprise a centrifugal blower comprising a blower housing, a blower impeller at least partially disposed within the blower housing, and a blower motor configured to selectively rotate the blower impeller. The indoor fan 112 may generally be configured to provide airflow 113 over the indoor heat exchanger 110 to promote heat transfer between the airflow 113 and a refrigerant flowing through the indoor heat exchanger 110. The indoor fan 112 may generally comprise a mixed-flow fan and/or any other suitable type of fan. The indoor fan 112 may generally be configured as a modulating and/or variable speed fan capable of being operated at many speeds over one or more ranges of speeds. In other embodiments, the indoor fan 112 may be configured as a multiple speed fan capable of being operated at a plurality of operating speeds by selectively electrically powering different ones of multiple electromagnetic windings of a motor of the indoor fan 112. In yet other embodiments, however, the indoor fan 112 may be a single speed fan.

Outdoor unit 104 generally comprises an outdoor heat exchanger 114, a compressor 116, an outdoor fan 118, an outdoor metering device 120, a reversing valve 122, an outdoor controller 126, and outdoor temperature sensor 154. The outdoor heat exchanger 114 may generally be configured to promote heat transfer between a refrigerant carried within internal passages or tubing of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In some embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or over the outdoor heat exchanger 114 to promote heat transfer between the airflow and a refrigerant flowing through the outdoor heat exchanger 114. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan.

The outdoor metering device 120 may generally comprise a thermostatic expansion valve. In some embodiments, however, the outdoor metering device 120 may comprise an electronically-controlled motor driven EEV similar to indoor metering device 108, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

Outdoor temperature sensor 154 may comprise any suitable device or collection of devices for determining a temperature (or value(s) indicative thereof) for an environment surrounding the outdoor temperature sensor 154. For instance, outdoor temperature sensor 154 may comprise a thermocouple, thermistor, infrared sensor, etc. In some embodiments, in addition to outdoor temperature sensor 154, the outdoor unit 104 may also comprise a plurality of temperature sensors for measuring the temperature of the outdoor heat exchanger 114, and/or the compressor 116. In still other embodiments, outdoor unit 102 may not include outdoor temperature sensor 154.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 through the indoor controller 124 and/or the outdoor unit 104 through the outdoor controller 126. In some embodiments, the system controller 106 may be configured to monitor and/or communicate, directly or indirectly, with a plurality of sensors associated with components of the indoor unit 102, the outdoor unit 104, etc. The sensors may measure or detect a variety of parameters, such as, for example, pressure, temperature, and flow rate of the refrigerant as well as pressure and temperature of other components or fluids of or associated with HVAC system 100. For example, system controller 106 may be in signal communication with outdoor temperature sensor 154 whereby system controller 106 may monitor ambient outdoor temperature. Additionally, in some embodiments, the system controller 106 may be configured to control heating and/or cooling of zones associated with the HVAC system 100 (e.g., within the indoor space).

The system controller 106 may also be in communication with or incorporated with an input/output (I/O) unit 107 (e.g., a graphical user interface, a touchscreen interface, or the like) for displaying information and for receiving user inputs. The I/O unit 107 may display information related to the operation of the HVAC system 100 (e.g., from system controller 106) and may receive user inputs related to operation of the HVAC system 100. For example, a user of HVAC system 100 (e.g., a homeowner and/or installer of HVAC system 100) may enter into I/O unit 107 a user defined temperature setting or setpoint for an indoor space. During operations, I/O unit 107 may communicate received user inputs to the system controller 106, which may then execute control of HVAC system 100 accordingly. Communication between the I/O unit 107 and system controller 106 may be wired, wireless, or a combination thereof. The I/O unit 107 may be positioned within the conditioned space 202 and may comprise one or more sensors, such as temperature or humidity sensors, for monitoring respective characteristics of the indoor space.

In some embodiments, the system controller 106 may be configured for selective bidirectional communication over a communication bus 128. Further, the system controller 106 may be configured to selectively communicate with HVAC system 100 components and/or remote device 130 via communication network 132. In some embodiments, the communication network 132 may comprise the Internet, and the remote device 130 may comprise a remote server, such as a cloud server having a cloud application installed that is configured to process information pertaining to plurality of climate control systems, including HVAC system 10. For instance, the cloud application may store data pertaining to actual and expected runtimes (determinable, e.g., via method 300 shown in FIG. 2) of an auxiliary heat source of a plurality of climate control systems. The cloud application may be accessible from a plurality of devices via the communication network 132. Additionally, the cloud application may reside and execute on one or more cloud servers.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to receive information related to the operation of components of indoor unit 102 (e.g., indoor metering device 108, indoor heat exchanger 110, indoor fan 112, auxiliary heat source 150, etc.) and to transmit control outputs or otherwise affect control over components of indoor unit 102.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to receive information related to the status and/or operation of components of outdoor unit 104 (e.g., outdoor heat exchanger 114, compressor 116, outdoor fan 118, outdoor metering device 120, and reversing valve 122, etc.) and to transmit control outputs or otherwise affect control over components of outdoor unit 104.

System controller 106, indoor controller 124, outdoor controller 126, and remote device 130 may each comprise any suitable device or assembly which is capable of receiving electrical (or other data) signals and transmitting electrical (or other data) signals to other devices. In particular, while not specifically shown, system controller 106, indoor controller 124, and outdoor controller 126 (as well as remote device 130) may each include a processor and a memory. The processors (e.g., microprocessor, central processing unit, or collection of such processor devices, etc.) may execute machine readable instructions (e.g., a non-transitory machine readable medium) provided on the corresponding memory to provide the processor with all of the functionality described herein. The memory of each controller 106, 124, 126 may comprise volatile storage (e.g., random access memory), non-volatile storage (e.g., flash storage, read only memory, etc.), or combinations of both volatile and non-volatile storage. Data consumed or produced by the machine readable instructions can also be stored on the memory of controllers 106, 124, 126.

As shown in FIG. 5, HVAC system 100 is configured for operating in a so-called heating mode in which heat may be absorbed by refrigerant at the outdoor heat exchanger 114 and rejected by the refrigerant at the indoor heat exchanger 110. Starting at the compressor 116, the compressor 116 may be operated to compress refrigerant and pump the relatively high temperature and high pressure compressed refrigerant to the indoor heat exchanger 110, where the indoor fan 112 may be operated to move airflow 113 into contact with the indoor heat exchanger 110, thereby transferring heat from the refrigerant to the airflow 113. After exiting the indoor heat exchanger, the refrigerant may flow through and/or bypass the indoor metering device 108, such that refrigerant flow is not substantially restricted by the indoor metering device 108. Refrigerant generally exits the indoor metering device 108 and flows to the outdoor metering device 120, which may meter the flow of refrigerant through the outdoor metering device 120 such that the refrigerant downstream of the outdoor metering device 120 is at a lower pressure than the refrigerant upstream of the outdoor metering device 120. From the outdoor metering device 120, the refrigerant may enter the outdoor heat exchanger 114. As the refrigerant is passed through the outdoor heat exchanger 114, the outdoor fan 118 may be operated to move air into contact with the outdoor heat exchanger 114, thereby transferring heat to the refrigerant from the air surrounding the outdoor heat exchanger 114. Refrigerant leaving the outdoor heat exchanger 114 may flow to the reversing valve 122, where the reversing valve 122 may be selectively configured to divert the refrigerant back to the compressor 116, where the refrigeration cycle may begin again.

In addition to the heating mode of HVAC system 100 described above, HVAC may also be configured for operation in the auxiliary heating mode referred to above, where, in addition to transferring heat from the indoor heat exchanger 110 to the airflow 113 produced by indoor fan 112, additional or auxiliary heat may also be transferred from auxiliary heat source 150 to the airflow 113 to provide additional heating to the indoor space (e.g., indoor space 201 shown in FIG. 1). Particularly, auxiliary heat source 150 may be positioned downstream from indoor fan 112 whereby the airflow 113 produced by indoor fan 112 flows over the electric heating element 152 and heat generated by electric heating element 152 is transferred to airflow 113. Thus, in the auxiliary heating mode of HVAC system 100, heat is transferred to airflow 113 from both indoor heat exchanger 110 (via the refrigeration cycle described above) and from auxiliary heat source 150 (via the conversion of electrical energy into thermal energy provided by electric heating element 152).

As described above, through use of the systems (e.g., HVAC system 100) and methods (e.g., method 300) described herein, a loss of heating capacity from a refrigeration cycle of a climate control system may be diagnosed by comparing an actual runtime of an auxiliary heat source (e.g., auxiliary heat source 150) of the climate control system over an evaluation period with an expected runtime over the evaluation period based on outdoor ambient conditions. The above described systems and methods particularly allow for the determination of the expected runtime of the auxiliary heat source without needing to account for the heat transfer properties of the exterior structure comprising an indoor space heated by the climate control system. Instead, the delay in heat transfer between an outdoor ambient area and the indoor space may be accounted for in the systems and methods described herein by accounting for outdoor ambient temperatures preceding the time period over which the expected runtime is determined. Accordingly, a climate control system utilizing the above described systems and methods may be operated whereby a user of the climate control system may be issued an alert notifying the user of a loss of heating capacity from the refrigeration cycle of the climate control system indicated by an actual runtime of an auxiliary heat source being greater than an expected runtime of the auxiliary heat source over an evaluation period.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of diagnosing a loss of capacity of a heating, ventilation, and air conditioning (HVAC) system, the method comprising:

(a1) monitoring a runtime of an auxiliary heat source using a processor;

(a2) summing, using the processor, the runtime of the auxiliary heat source of the HVAC system over a plurality of time blocks;

(b) summing, using the processor, an expected runtime of the auxiliary heat source over the plurality of time blocks, wherein the expected runtime comprises the following relationship: $(DT-ODT_{eff})*C$, wherein DT comprises a predetermined design temperature of the HVAC system, C comprises a constant factor, and $ODT_{eff}$ comprises an outdoor ambient temperature occurring during a time-delay block;

(c) comparing, using the processor, the runtime sum with the expected runtime sum; and (d) issuing an alert, using the processor, to the user of the climate control system in response to the runtime sum being greater than the expected runtime sum, the alert indicative of a loss of heating capacity from a refrigerant circuit of the HVAC system;

wherein the expected runtime for each of the plurality of time blocks is a function of an outdoor ambient temperature over the time-delay block beginning before the corresponding time block.

2. The method of claim 1, wherein the expected runtime for each of the plurality of time blocks is a function of one of a minimum outdoor ambient temperature over the time-delay block, an average outdoor ambient temperature over the time-delay block, a median outdoor ambient temperature over the time-delay block, and a lowest quartile ambient outdoor temperature over the time-delay block.

3. The method of claim 1, wherein a duration of the time-delay block is greater than a duration of the corresponding time block.

4. The method of claim 3, wherein the duration of the time-delay block comprises the duration of the corresponding time block plus a period of time directly preceding the corresponding time block.

5. The method of claim 4, wherein the period of time directly preceding the corresponding time block is between 0.5 hours and 6.0 hours in duration.

6. The method of claim 1, wherein a duration of time directly following a change in a temperature setpoint for an indoor area heated by the HVAC system is excluded when summing the runtime at (a2) and summing the expected runtime at (b).

7. The method of claim 6, wherein the duration of time to be excluded is determined using the following relationship:

$$\frac{(SP_{new} - IDT)}{C_{sp}},$$

where $SP_{new}$ comprises a new temperature setpoint following the change in the temperature setpoint, IDT comprises a current temperature in the indoor space, and $C_{sp}$ comprises a constant factor.

8. The method of claim 6, wherein the duration of time to be excluded is determined using the following relationship:

$$\frac{(SP_{new} - SP_{old})}{C_{sp}},$$

where $SP_{new}$ comprises a new temperature setpoint following the change in the temperature setpoint, $SP_{old}$ comprises an old temperature setpoint directly preceding the change in the temperature setpoint, and $C_{sp}$ comprises a constant factor.

9. The method of claim 1, wherein the $ODT_{eff}$ comprises the lowest outdoor ambient temperature occurring during the time-delay block.

10. A non-transitory machine-readable medium including instructions directed to diagnosing a loss of capacity of a heating, ventilation, and air conditioning (HVAC) system, the instructions that, when executed by a processor, cause the processor to:

(a1) monitoring a runtime of an auxiliary heat source using a processor;

(a2) sum the runtime of the auxiliary heat source of a heating, ventilation, and air conditioning (HVAC) system over a plurality of time blocks;

(b) sum an expected runtime over the plurality of time blocks, wherein the expected runtime comprises the following relationship:$(DT-ODT_{eff})*C$, wherein DT comprises a predetermined design temperature of the HVAC system, C comprises a constant factor, and $ODT_{eff}$ comprises an outdoor ambient temperature occurring during a time-delay block;

(c) compare the runtime sum with the expected runtime sum; and (d) issue the alert to the user of the climate control system in response to the runtime sum being greater than the expected runtime sum, the alert indicative of a loss of heating capacity from a refrigerant circuit of the HVAC system;

wherein the expected runtime for each of the plurality of time blocks is a function of an outdoor ambient temperature over the time-delay block beginning before the corresponding time block.

11. The non-transitory machine-readable medium of claim 10, wherein the expected runtime for each of the plurality of time blocks is a function of one of a minimum outdoor ambient temperature over the time-delay block, an average outdoor ambient temperature over the time-delay block, a median outdoor ambient temperature over the time-delay block, and a lowest quartile ambient outdoor temperature over the time-delay block.

12. The non-transitory machine-readable medium of claim 10, wherein a duration of the time-delay block is greater than a duration of the corresponding time block.

13. The non-transitory machine-readable medium of claim 10, wherein the duration of the time-delay block comprises the duration of the corresponding time block plus a period of time directly preceding the corresponding time block.

14. The non-transitory machine-readable medium of claim 13, wherein the period of time directly preceding the corresponding time block is between 0.5 hours and 6.0 hours in duration.

15. The non-transitory machine-readable medium of claim 10, wherein the instructions, when executed by the processor, further cause the processor to:

exclude a duration of time directly following a change in a temperature setpoint for an indoor area heated by the HVAC system when summing the runtime and the expected runtime.

16. The non-transitory machine-readable medium of claim 15, wherein the instructions, when executed by the processor, further cause the processor to determine the duration of time to be excluded using the following relationship:

$$\frac{(SP_{new} - IDT)}{C_{sp}},$$

where $SP_{new}$ comprises a new temperature setpoint following the change in the temperature setpoint, IDT comprises a current temperature in the indoor space, and $C_{sp}$ comprises a constant factor.

17. The non-transitory machine-readable medium of claim 15, wherein the instructions, when executed by the processor, further cause the processor to determine the duration of time to be excluded using the following relationship:

$$\frac{(SP_{new} - SP_{old})}{C_{sp}},$$

where $SP_{new}$ comprises a new temperature setpoint following the change in the temperature setpoint, $SP_{old}$ comprises an old temperature setpoint directly preceding the change in the temperature setpoint, and $C_{sp}$ comprises a constant factor.

18. The non-transitory machine-readable medium of claim 10, wherein the $ODT_{eff}$ comprises the lowest outdoor ambient temperature occurring during the time-delay block.

* * * * *